US007201604B1

(12) United States Patent
Amidon

(10) Patent No.: US 7,201,604 B1
(45) Date of Patent: Apr. 10, 2007

(54) ETHERNET CABLE CONNECTOR AND METHODS OF USE THEREOF

(75) Inventor: Jeremy Amidon, Onondaga, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/377,596

(22) Filed: Mar. 16, 2006

(51) Int. Cl.
*H01R 13/58* (2006.01)

(52) U.S. Cl. ..... 439/469; 439/418

(58) Field of Classification Search ..... 439/395, 439/346, 404, 469, 460, 417, 418
See application file for complete search history.

(56) References Cited

U.S. PATENT DOCUMENTS 4,969,839 A * 11/1990 Nilsson ..... 439/395
5,599,202 A * 2/1997 Key ..... 439/459
6,116,952 A * 9/2000 Nakata ..... 439/587
6,162,085 A * 12/2000 Chugh et al. ..... 439/467
6,193,539 B1 * 2/2001 Chang ..... 439/346
6,368,129 B1 * 4/2002 Wang et al. ..... 439/260
7,048,563 B2 * 5/2006 Fukuda et al. ..... 439/276
7,070,443 B2 * 7/2006 Tashiro et al. ..... 439/419

* cited by examiner

*Primary Examiner*—Chandrika Prasad
*Assistant Examiner*—Harshad C Patel
(74) *Attorney, Agent, or Firm*—Schmeiser, Olsen & Watts

(57) ABSTRACT

An ethernet cable connector for coupling an ethernet cable and providing contact between insulated wires of the ethernet cable and insulation displacement contacts within the connector. The connector includes an inner body having a clamp, a plurality of holes and a plurality of recesses transverse to the plurality of holes. Each hole receives a wire of an ethernet cable. The outer body is operatively coupled to the inner body and is configured to couple insulation displacement contacts within the outer body. The insertion of the inner body within the outer body bends the wires of the ethernet cable to rest within the plurality of recesses of the inner body, engages the insulation displacement contacts with the ethernet wires and compresses the clamp around a portion of the ethernet cable, thereby providing strain reduction to the ethernet wires.

15 Claims, 5 Drawing Sheets

ETHERNET CABLE CONNECTOR AND METHODS OF USE THEREOF

BACKGROUND OF INVENTION

1. Technical Field

This invention relates generally to the field of connectors for use with an ethernet cable. More particularly, this invention provides for a connector having an inner body insertable within an outer body to make secure mechanical and electrical contact with the wires of the ethernet cable.

2. Related Art

Heretofore, connectors for use with ethernet cables require the wires of the cable to be fed the entire length of the connector. Further, typical connectors pinch an ethernet cable with a bar to hold the cable inside the connector.

Two problems arise from this method of coupling a connector to an ethernet cable. First, feeding the wires the length of the connector make it difficult to maintain a twisted configuration of the ethernet wires, which configuration is common among all ethernet cables. Second, the use of a bar to pinch the ethernet cable only secures the cable at one point. This pinching of the cable at one point leads to problems of retaining the cable in secure connection with the connector and further problems with strain relief from the contacts.

Accordingly, there is a need in the field of connectors for use with ethernet cables for an improved connector.

SUMMARY OF INVENTION

The present invention provides an ethernet cable connector that uses an inner body for coupling to an ethernet cable, the inner body being inserted into an outer body to contact insulation displacement contacts coupled within the outer body.

A first general aspect of the invention provides a connector for coupling an end of an ethernet cable, the connector comprising: an inner body having a first end and second opposing end, the second end having a plurality of holes and a plurality of recesses transverse to the plurality of holes, each hole receiving an insulated wire of an ethernet cable and each recess corresponding to a single hole; and an outer body, operatively coupled to the inner body, the outer body having a first end and second opposing end, the first end having a recess and the second end configured to couple insulation displacement contacts within the outer body, the recess of the first end of the outer body configured to receive the inner body, wherein the insertion of the inner body within the outer body bends the wires of the ethernet cable to rest within the plurality of recesses of the inner body and engages the insulation displacement contacts with the ethernet wires.

A second general aspect of the invention provides a connector for coupling an end of an ethernet cable, the connector comprising: an inner body having a first end and second opposing end, the first end having a clamp and the second end having a plurality of holes and a plurality of recesses transverse to the plurality of holes, each hole receiving a wire of an ethernet cable and each recess corresponding to a single hole; and an outer body, operatively coupled to the inner body, the outer body having a first end and second opposing end, the first end having a recess and the second end configured to couple insulation displacement contacts within the outer body, the recess of the first end of the outer body configured to receive the inner body, wherein the insertion of the inner body with the outer body bends the wires of the ethernet cable to rest within the plurality of recesses of the inner body, engages the insulation displacement contacts with the ethernet wires and compresses the clamp around a portion of the ethernet cable securely retaining the cable in a position configured to reduce strain on the ethernet wires.

A third general aspect of the present invention provides an ethernet cable connector comprising: an inner body; an outer body configured to receive the inner body; and means for coupling an ethernet cable to the inner body, wherein the means reduce strain on wires of the ethernet cable when the inner body is received by the outer body.

A fourth general aspect of the present invention provides a method of coupling a connector to an end of an ethernet cable, the method comprising the steps of: providing a connector, said connector having an inner body and an outer body; inserting insulated ethernet wires into holes of the inner body of the connector; removing excess wire;

inserting the inner body of the connector into the outer body of the connector, wherein the action of inserting the inner body into the outer body of the connector includes bending a portion of the insulated ethernet wires into a transverse position to rest within recesses and compressing a clamp of the inner body onto the ethernet cable; and engaging the ethernet wires with insulation displacement contacts when the inner body is inserted into the outer body.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
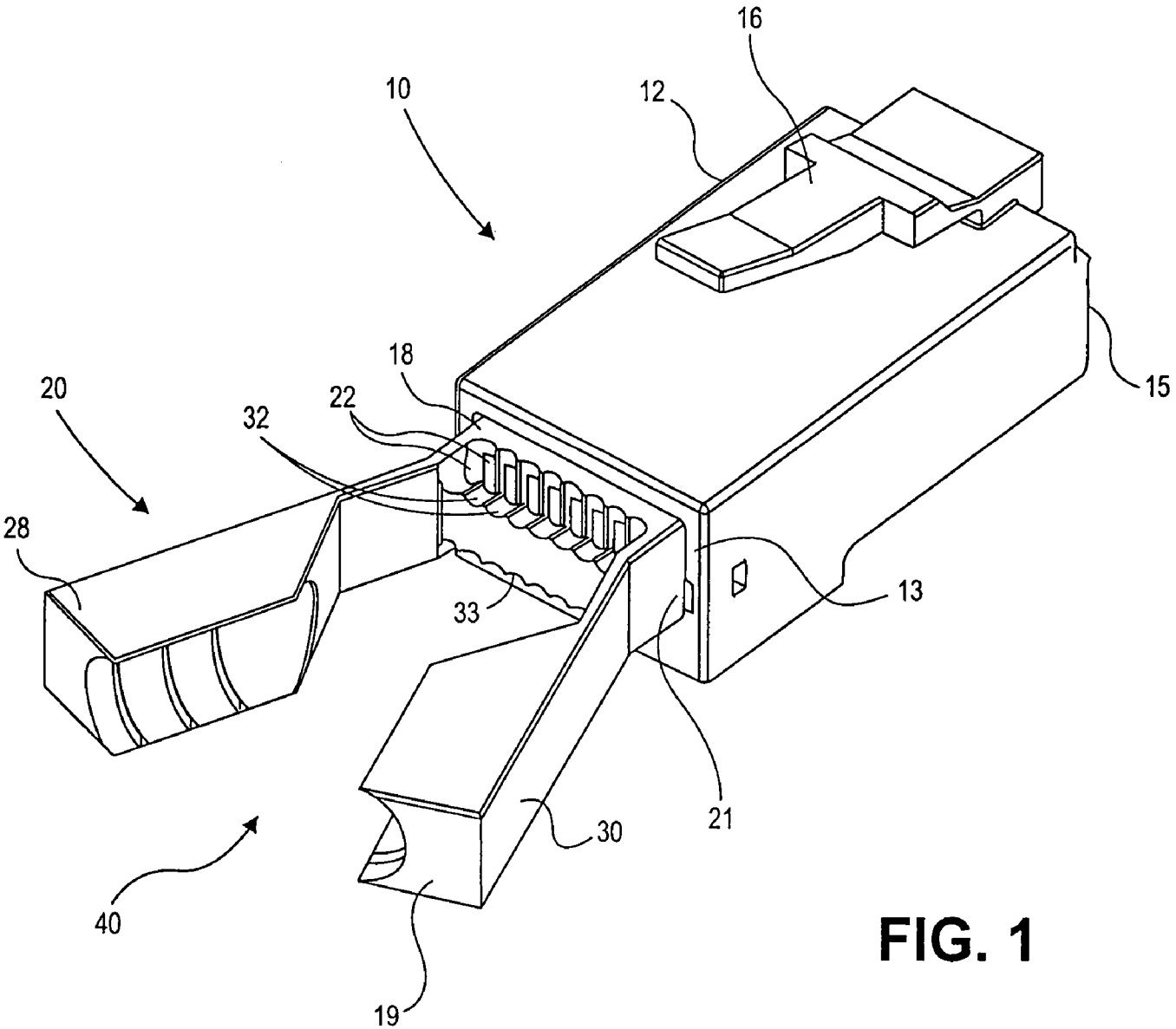
FIG. 1 depicts a perspective view of an embodiment of an ethernet cable connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

Figure 2:
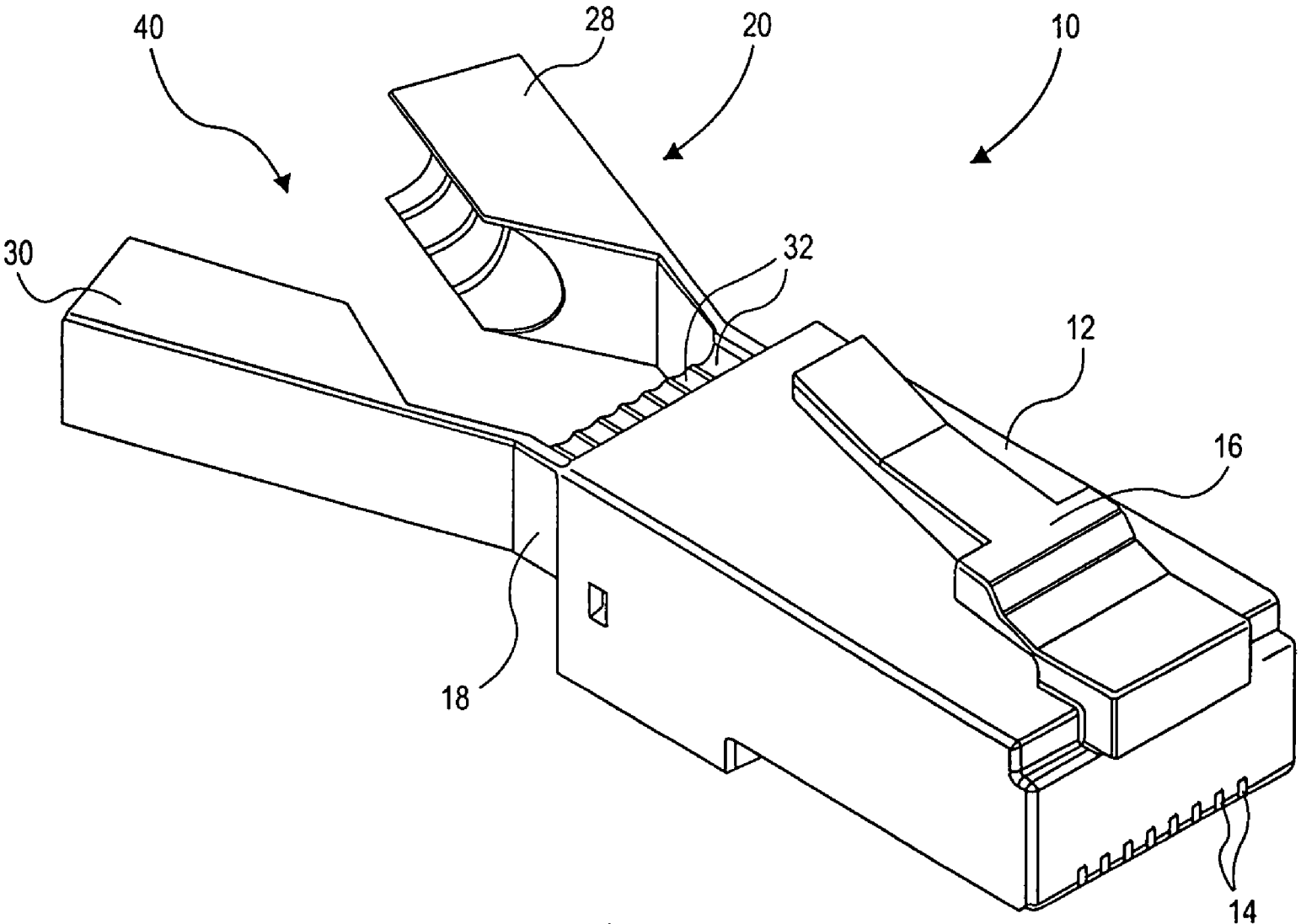
FIG. 2 depicts another perspective view of the embodiment of the ethernet cable connector of FIG. 1, in accordance with the present invention.

Referring to the drawings, FIGS. 1 and 2 depict one embodiment of an ethernet cable connector 10. The connector 10 may include an outer body 12 and an inner body 18. The inner body 18 may have a first end 19 and second opposing end 21, the second end 21 having a plurality of holes 22 and a plurality of recesses 32 transverse to the plurality of holes 22, each hole 22 receiving an insulated wire of an ethernet cable and each recess 32 corresponding to a single hole 22. Further the second end may include bottom recesses 33, each bottom recess 33 corresponding to a single hole 22. The first end 19 of the inner body 18 may include a clamp 20. The clamp 20 may include a first clamp portion 28, a second opposing clamp portion 30 and a central passageway 40 between the first and second portions 28 and 30, wherein the passageway is configured to receive a portion of an ethernet cable.

It will be understood by those of ordinary skill in the art that the plurality of holes 22 may be in various forms, such as, but not limited to, individual holes, a single slot with grooves separating hole portions for each wire and any combination thereof. Further the individual holes and/or the grooves may be of any shape, such as, but not limited to a circle, a rectangle, a square, a triangle, an oval or any other shape so long as the hole has sufficient size to receive an ethernet cable wire.

It will further be understood by those of ordinary skill in the art that the plurality of recesses 32 corresponding to the holes 22 may also be of any shape, such as, but not limited to a circle, a rectangle, a square, a triangle, an oval or any other shape so long as the hole has sufficient size to receive an ethernet cable wire. Additionally, the recesses 32 may be adjacent to the holes 22 or at a certain distance from the holes 22, so long as the recesses receive the wires and are able to isolate each wire from the others to avoid contact between wires.

The outer body 12 is operatively coupled to the inner body 18, the outer body 12 having a first end 13 and second opposing end 15, the first end 13 having a recess or opening and the second end 15 configured to couple insulation displacement contacts (IDC's) 14 within the outer body 12. The recess or opening of the first end 13 of the outer body 12 may be configured to receive the inner body 18, wherein the insertion of the inner body 18 within the outer body 12 bends the wires of an ethernet cable to rest within the plurality of recesses 32 of the inner body 18 and engages the IDC's 14 with the ethernet wires.

Figure 3:
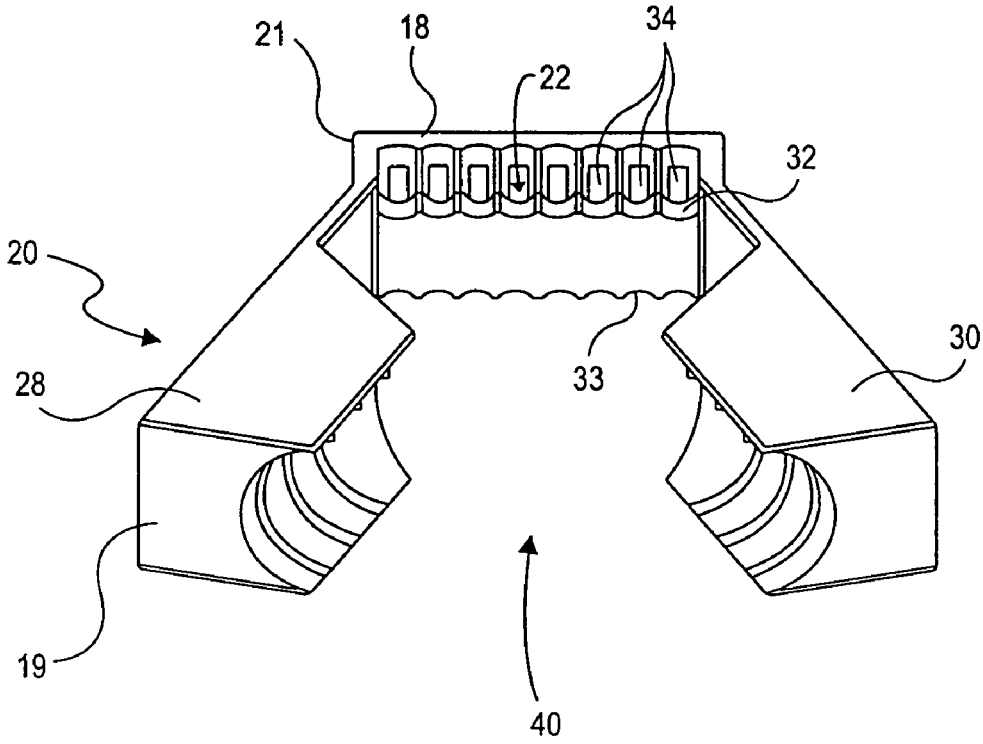
FIG. 3 depicts a perspective view of an embodiment of an inner body of an ethernet cable connector, in accordance with the present invention.

Referring further to the drawings, FIG. 3 depicts an embodiment of the inner body 18 in accordance with the present invention. The inner body 18 may have a first end 19 and second opposing end 21, the second end 21 having a plurality of holes 22 and a plurality of recesses 32 transverse to the plurality of holes 22 Each recesses 32 may correspond to a single hole 22. Each hole 22 receives an insulated wire of an ethernet cable. As the wires extend through the holes 22, the wires may be bent and rest within the recesses 32. The second end 21 may further include bottom recesses 33. The bottom recesses 33 may be transverse to the holes 22 with each bottom recess 33 corresponding to a single hole 22. The bottom recesses 33 may receive a portion of the insulated wires allowing the ethernet cable to extend in a transverse direction away from the holes 22. The second end 21 of the inner body 18 may further include a plurality of access apertures 34, wherein each access aperture 34 corresponds to a single hole 22 of the plurality of holes 22 to provide access to the ethernet wires for engagement with the IDC's 14.

The first end 19 of the inner body 18 may include a clamp 20 for clamping an ethernet cable, the clamp 20 including a first clamp portion 28, a second opposing clamp portion 30 and a central passageway 40 between the first and second portions 28 and 30, wherein the passageway 40 is configured to receive a portion of an ethernet cable. Upon insertion of the inner body 18 into the outer body 12, the volume of the central passageway 40 is reduced diametrically to grip a portion of an ethernet cable. The first and second clamp portions 28 and 30 may be hingedly coupled to the inner body 18. This hinged attachment allows for the portions to clamp onto an ethernet cable as force is applied to the first and second portions 28 and 30 such that the clamp portions 28 and 30 are pressed toward each other. This force may be generated by inserting the inner body 18 into the outer body 12 wherein the size of the recess or opening within the outer body 12 forces the clamp portion 28 and 30 toward each other in order for the inner body to be fully inserted within the outer body 12.

It will be understood that the clamp 20 is not limited to the clamp portions 28 and 30 as shown in FIG. 3, but may be another type of clamp 20 such as, but not limited to, a fastener, a catch, a clasp, a clench, a grip, a hold, a lock, a press, a snap and a vice so long as the ethernet cable is securely gripped and that the clamping action is actuated by the inserting of the inner body 18 within the outer body 12.

Figure 4:
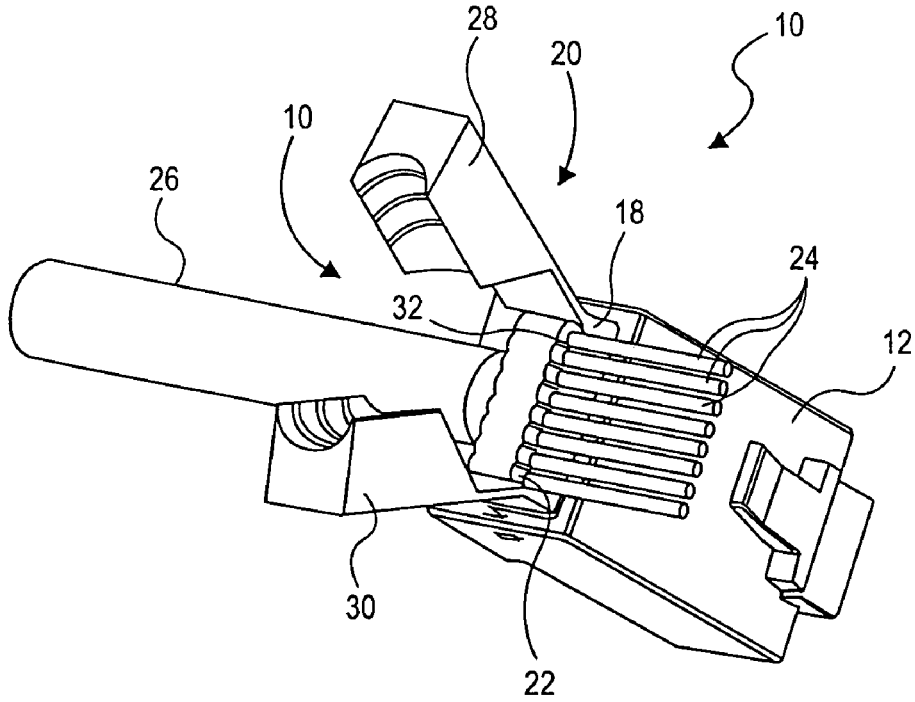
FIG. 4 depicts a perspective view of an ethernet cable being coupled to an embodiment of an ethernet cable connector, in accordance with the present invention.
Figure 5:
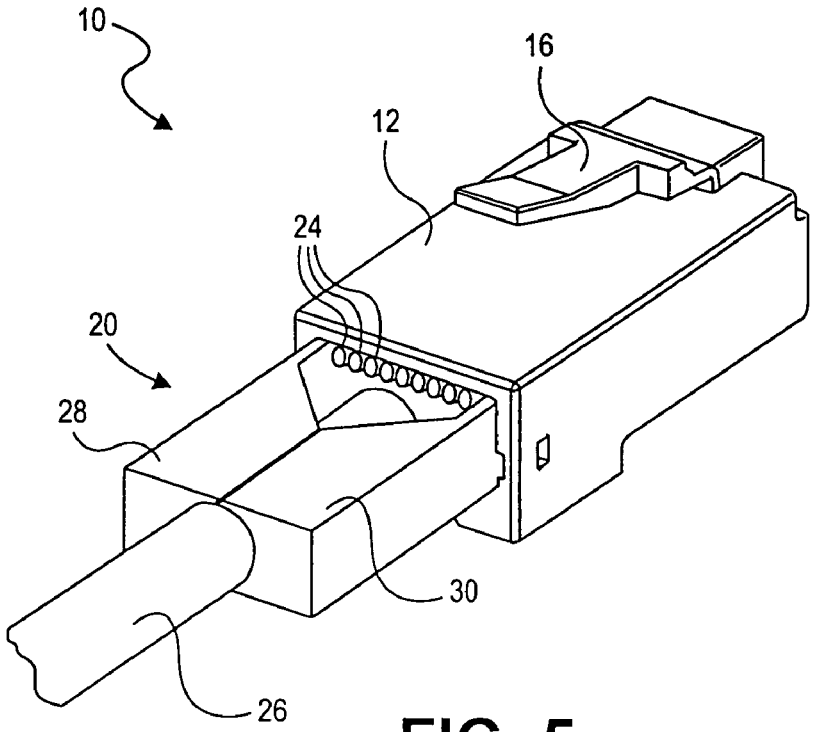
FIG. 5 depicts a perspective view of an embodiment of an ethernet cable connector with an inner body partially inserted within an outer body, in accordance with the present invention.
Figure 6:
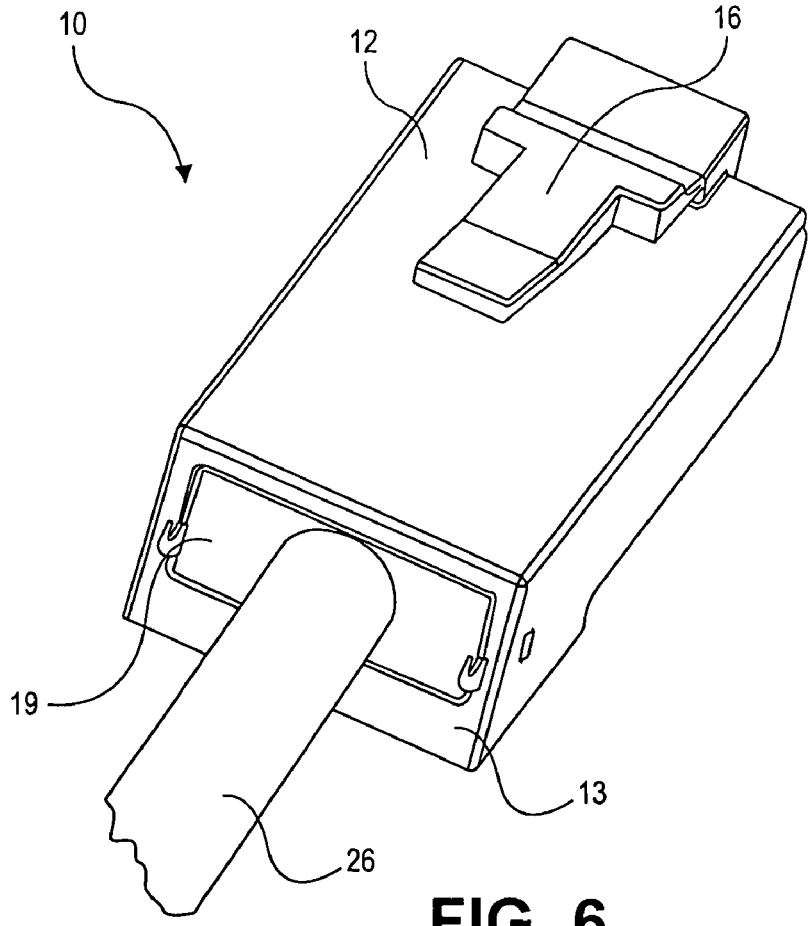
FIG. 6 depicts a perspective view of an embodiment of an ethernet cable connector with an inner body fully inserted within an outer body, in accordance with the present invention.

With further reference to the drawings, FIGS. 4–6 depict coupling of an ethernet cable connector 10 to an ethernet cable 26. The ethernet cable 26 comprises insulated wires 24. The connector 10 comprises an outer body 12 and an inner body 18. The inner body 18 may have a first end 19 and second opposing end 21, the second end 21 having a plurality of holes 22 and a plurality of recesses 32 transverse to the plurality of holes 22. The first end 19 of the connector 10 may include a clamp 20, holes 22, recesses 32 and bottom recesses 33. The clamp 20 may include a first clamp portion 28, a second opposing clamp portion 30 and a central passageway 40 between the first and second portions 28 and 30, wherein the passageway is configured to receive a portion of the ethernet cable 26. The outer body 12 is operatively coupled to the inner body 18, the outer body 12 having a first end 13 and second opposing end 15, the first end 13 having a recess or opening and the second end 15 configured to couple insulation displacement contacts (IDC's) 14 within the outer body 12. The recess or opening of the first end 13 of the outer body 12 may be configured to receive the inner body 18.

The wires 24 are received by the plurality of holes 22. The number of holes 22 is determined by the ethernet cable 26. The number of holes may be adapted to various types of ethernet cables 26 having a particular number of wires 24. For the exemplary purposes of this disclosure, and not viewed as a limitation, the ethernet cable may be a category five or a category six ethernet cable, wherein the ethernet cable has eight wires 24 and the connector 10 has eight holes 22, recesses 32 and bottom recesses 33 corresponding to the wires 24.

Once the wires 24 are received by the holes 22, the wires 24 may be trimmed to remove any excess wire, such as, but not limited to, wires that are excessive in length and may inhibit the proper insertion of the inner body 18 within the outer body 12. The inner body 18 may then be inserted within the outer body 12. The insertion of the inner body 18 within the outer body 12 bends the wires 24 of the ethernet cable 26 to rest within the plurality of recesses 32 of the inner body 18, such that the wires 24 extend transverse and away from the holes 22, as seen in FIG. 5. It will be understood that the bending of the wires 24 does not require an additional action, but is accomplished with the insertion of the inner body 18 within the outer body 12. As further seen in FIG. 5, the insertion of the inner body 18 into the outer body 12 may further engage the clamp 20 onto the ethernet cable 26, wherein the clamp 20 diametrically grips the ethernet cable 26 along a length to provide strain relief to the ethernet cable 26.

In particular embodiments of the present invention, and with reference to FIG. 5, the ethernet cable 26 is received within the central passageway 40 and the first clamp portion 28 and the second clamp portion 30 are forced toward each other due to the insertion of the inner body 18. The forcing of the clamp portions 28 and 30 toward each other reduces the volume of the center passageway 40 diametrically to grip the portion of the ethernet cable 26. As the inner body 18 is further inserted within the outer body 12, the grip of the clamp 20 is strengthened.

As seen in FIG. 6, when the inner body 18 is fully inserted within the outer body 12, the first end 19 of the inner body 18 is adjacent to the first end 13 of the outer body. Further, the second end of the inner body 21 and the second end 15 of the outer body are also adjacent such that the IDC's 14 engage the insulated wires 24. The engagement of the IDC's 14 may further include cutting the insulation of the plurality of wires 24 to make mechanical and electrical contact with the plurality of wires 24. Additionally, the inner body 18 is secured within the outer body 12 when the inner body 18 is fully inserted. It will be understood by those of ordinary skill in the art that the inner body 18 may be secured within the outer body 12 in various ways, including, but not limited to, a press fit, a clip, a compliant clip, a tab, a lock and any combination thereof. Once the inner body 18 is fully inserted within outer body 12, the connector 10 is ready for use and may be inserted within an ethernet jack, with the locking tab 16 removably locking the connector 10 within the jack.

In various embodiments of the present invention, strain on the wires 24 of the ethernet cable 26 may be reduced by means for coupling the ethernet cable 26 to the inner body 18 when the inner body 18 is received by the outer body 12. The means may include an initial location of wires 24 in holes 22 such that a portion of each of the wires 24 extends beyond the surface of the inner body 18. Moreover, the means may include the location of wires with recesses 32 when the inner body 18 is received by the outer body 12, via the bending of the wires 24 through insertable operation of the inner body 18. Furthermore, the means may include the secure retention of the cable 26 at a location along the external length of the cable by a clamp portion 20 of the inner body 18 compressed against and securely retaining the cable 26 when the inner body 18 is received by the outer body 12. Hence the wires 24 have reduced strain, inter alia, because the cable 26 is retained by the secure compressed position of the clamp portion 20 when the inner body 18 is received by the outer body 12.

Figure 7:
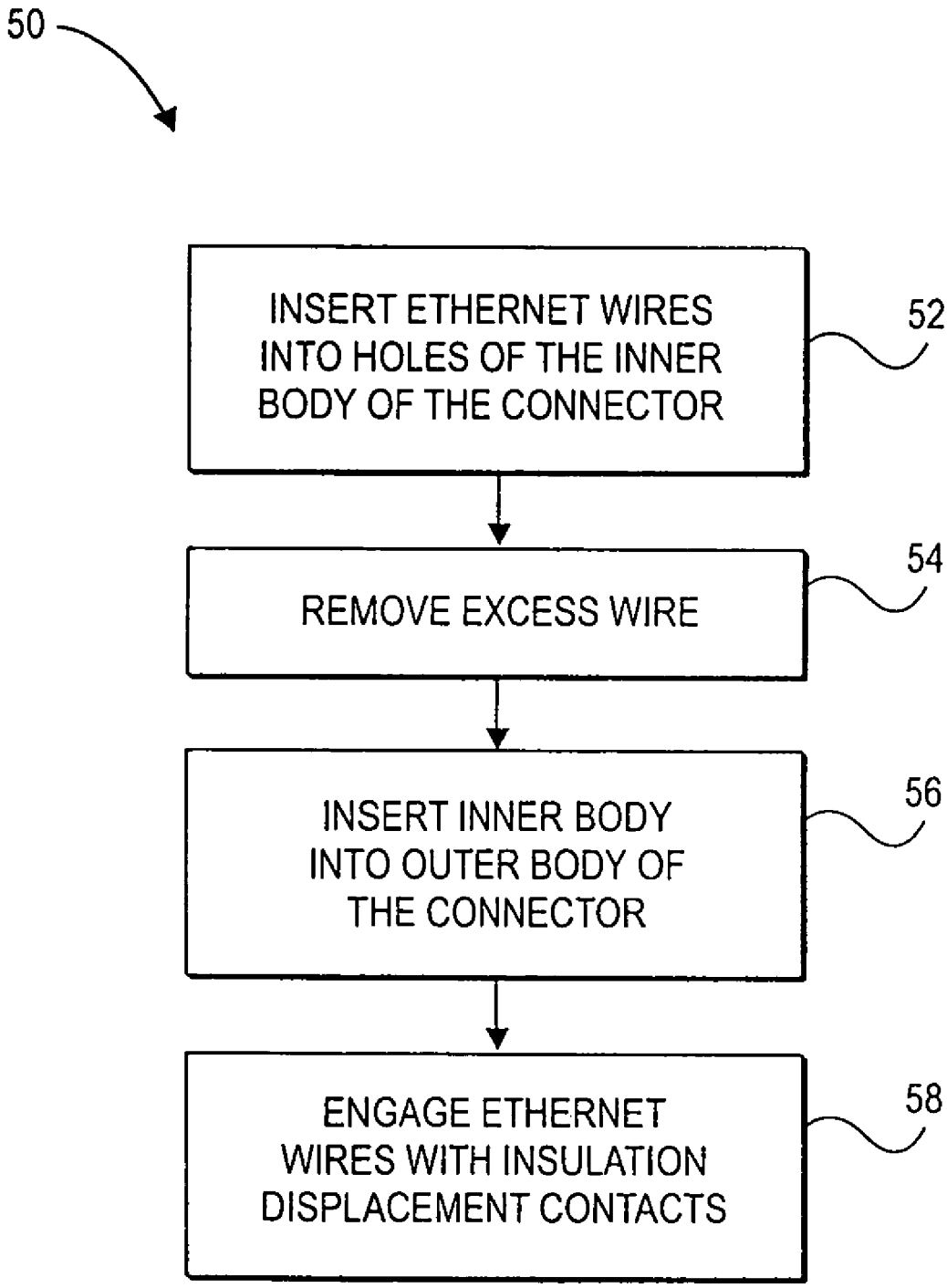
FIG. 7 depicts a flow chart of an embodiment of a method of use of an ethernet cable connector, in accordance with the present invention.

Referring further to the drawings, FIG. 7, depicts a method 50 of use of an ethernet cable connector. The method may comprise a step of providing an ethernet connector comprising in inner body and an outer body. Moreover, the method may include the steps of inserting insulated ethernet wires into holes of an inner body of a connector (Step 52), removing excess wire (Step 54), inserting the inner body of the connector into an outer body of the connector (Step 56), wherein the action of inserting the inner body into the outer body of the connector includes bending a portion of the insulated ethernet wires into a transverse position to rest within recesses and compressing a clamp of the inner body onto the ethernet cable and engaging the ethernet wires with insulation displacement contacts when the inner body is inserted into the outer body (Step 58). The sub-step of Step 56 of clamping a clamp onto an ethernet cable may further include gripping the ethernet cable diametrically along a portion of the ethernet cable and providing strain relief by gripping a length of the cable. Step 58 of method 50 of engaging the ethernet wires with insulation displacement contacts may further include cutting the insulation and contacting the conductive wire mechanically and electrically.

While the present invention has been described and illustrated herein with respect to preferred embodiments, it should be apparent that various modifications, adaptations and variations may be made utilizing the teachings of the present disclosure without departing from the scope of the invention and are intended to be within the scope of the present invention. In light of the foregoing, it will now be appreciated by those skilled in art that modifications may be made to the disclosed embodiments without departing from the spirit and scope of the invention as defined by the appended claims.

I claim:

1. A connector for coupling an end of an ethernet cable, the connector comprising:

an inner body having a first end and second opposing end, the second end having a plurality of holes and a plurality of recesses transverse to the plurality of holes, each hole receiving an insulated wire of an ethernet cable and each recess corresponding to a single hole; and an outer body, operatively coupled to the inner body, the outer body having a first end and second opposing end, the first end having an opening and the second end configured to couple insulation displacement contacts within the outer body, the opening of the first end of the outer body configured to receive the inner body, wherein the insertion of the inner body within the outer body bends the wires of the ethernet cable to rest within the plurality of recesses of the inner body and engages the insulation displacement contacts with the ethernet wires.

2. The connector of claim 1, wherein the second end of the inner body further includes a plurality of access apertures, wherein each access aperture corresponds to a single hole of the plurality of holes to provide access to the ethernet wires for engagement with the insulation displacement contacts.

3. The connector of claim 1, wherein the first end of the inner body includes a clamp for clamping the ethernet cable.

4. The connector of claim 3, wherein the insertion of the inner body into the outer body further engages the clamp onto an ethernet cable, wherein the clamp diametrically grips the ethernet cable along a length to provide strain relief to the ethernet cable.

5. The connector of claim 4, wherein the clamp includes an first portion, a second opposing portion and a central passageway between the first and second portions, wherein the central passageway is configured to receive a portion of the ethernet cable and upon insertion of the inner body into the outer body, the volume of the central passageway is reduced diametrically to grip the portion of the ethernet cable.

6. The connector of claim 1, wherein the engagement of the insulation displacement contacts further includes the cutting the insulation of the plurality of wires to make mechanical and electrical contact with the plurality of wires.

7. The connector of claim 1, wherein the inner body is secured within the outer body when the inner body is fully inserted.

8. A connector for coupling an end of an ethernet cable, the connector comprising:

an inner body having a first end and second opposing end, the first end having a clamp and the second end having a plurality of holes and a plurality of recesses transverse to the plurality of holes, each hole receiving a wire of an ethernet cable and each recess corresponding to a single hole; and an outer body, operatively coupled to the inner body, the outer body having a first end and second opposing end, the first end having an opening and the second end configured to couple insulation displacement contacts within the outer body, the opening of the first end of the outer body configured to receive the inner body, wherein the insertion of the inner body within the outer body bends the wires of the ethernet cable to rest within the plurality of recesses of the inner body, engages the insulation displacement contacts with the ethernet wires and compresses the clamp around a portion of the ethernet cable securely retaining the cable in a position configured to reduce strain on the ethernet wires.

9. The connector of claim 8, wherein the second end of the inner body further includes a plurality of access apertures, wherein each access aperture corresponds to a single hole of the plurality of holes to provide access to the ethernet wires for engagement with the insulation displacement contacts.

10. The connector of claim 8, wherein the clamp includes an first portion, a second opposing portion and a central passageway between the first and second portions, wherein the central passageway is configured to receive a portion of the ethernet cable and upon insertion of the inner body into the outer body, the volume of the central passageway is reduced diametrically to grip the portion of the ethernet cable.

11. The connector of claim 8, wherein the engagement of the insulation displacement contacts further includes the insulation displacement contacts cutting the insulation of the plurality of wires to make mechanical and electrical contact with the plurality of wires.

12. The connector of claim 8, wherein the inner body is secured within the outer body when the inner body is fully inserted.

13. A method of coupling a connector to an end of an ethernet cable, the method comprising the steps of:

providing a connector, said connector having an inner body and an outer body;

inserting insulated ethernet wires into holes of the inner body of the connector;

removing excess wire;

inserting the inner body of the connector into the outer body of the connector, wherein the action of inserting the inner body into the outer body of the connector includes bending a portion of the insulated ethernet wires into a transverse position to rest within recesses and compressing a clamp of the inner body onto the ethernet cable; and engaging the ethernet wires with insulation displacement contacts when the inner body is inserted into the outer body.

14. The method of claim 13, wherein clamping a clamp onto an ethernet cable further includes gripping the ethernet cable diametrically along a portion of the ethernet cable and providing strain relief by gripping a length of the cable.

15. The method of claim 13, wherein engaging the ethernet wires with insulation displacement contacts further includes cutting the insulation and contacting the conductive wire mechanically and electrically.

* * * * *

UNITED STATES PATENT AND TRADEMARK OFFICE

CERTIFICATE OF CORRECTION

PATENT NO. : 7,201,604 B1
APPLICATION NO. : 11/377596
DATED : April 10, 2007
INVENTOR(S) : Amidon It is certified that error appears in the above-identified patent and that said Letters Patent is hereby corrected as shown below:

Column 3
Line 63, delete "22 Each" and insert --22. Each --

Column 6
Line 2, delete "in" and insert -- an --
Line 66, delete "an" and insert -- a --

Column 7
Line 40, delete "an" and insert -- a --

Signed and Sealed this

Twenty-sixth Day of June, 2007

JON W. DUDAS
*Director of the United States Patent and Trademark Office*